US009702047B2

(12) United States Patent
Stapley et al.

(10) Patent No.: US 9,702,047 B2
(45) Date of Patent: Jul. 11, 2017

(54) METHODS FOR THE ELECTROLYTIC DECARBOXYLATION OF SUGARS

(71) Applicant: Dynamic Food Ingredients Corporation, Kirkland, WA (US)

(72) Inventors: Jonathan A. Stapley, Bellevue, WA (US); J. David Genders, Elma, NY (US)

(73) Assignee: Dynamic Food Ingredients Corporation, Kirkland, WA (US)

( * ) Notice: Subject to any disclaimer, the term of this patent is extended or adjusted under 35 U.S.C. 154(b) by 0 days.

(21) Appl. No.: 14/775,359

(22) PCT Filed: Mar. 10, 2014

(86) PCT No.: PCT/US2014/022689

§ 371 (c)(1),
(2) Date: Sep. 11, 2015

(87) PCT Pub. No.: WO2014/164523

PCT Pub. Date: Oct. 9, 2014

(65) Prior Publication Data

US 2016/0024668 A1 Jan. 28, 2016

Related U.S. Application Data

(60) Provisional application No. 61/777,890, filed on Mar. 12, 2013.

(51) Int. Cl.

| | |
|---|---|
| ***C25B 3/00*** | (2006.01) |
| ***C25B 3/02*** | (2006.01) |
| ***C25B 1/16*** | (2006.01) |
| ***C25B 15/08*** | (2006.01) |
| ***C25B 9/18*** | (2006.01) |

(52) U.S. Cl.

CPC ..... *C25B 3/00* (2013.01); *C25B 3/02* (2013.01); *C25B 9/18* (2013.01); *C25B 15/08* (2013.01)

(58) Field of Classification Search

CPC ..... C25B 1/16; C25B 3/00; C25B 3/02
USPC ..... 205/413, 448, 449, 510, 512, 440
See application file for complete search history.

(56) References Cited

U.S. PATENT DOCUMENTS

2007/0181437 A1* 8/2007 Stapley ..... C07C 29/141 205/454
2011/0024288 A1 2/2011 Bhavaraju et al.
2011/0180418 A1* 7/2011 Stapley ..... C25B 3/02 205/448
2011/0272291 A1 11/2011 Stapley et al.

FOREIGN PATENT DOCUMENTS

JP 2007224328 A * 9/2007 ..... C23F 1/46

OTHER PUBLICATIONS

Hay et al., "Electrolysis of Low Molecular Weight Carbohydrates in Non-Aqueous Media. I. The Products of Electrolysis of Monosaccharides," Canadian Journal of Chemistry (no month, 1969), vol. 47, pp. 417-421.*
International Search Report for International Application No. PCT/US2014/022689, dated Jun. 24, 2014 (3 pages).
Pergola, F., et al., "Direct Electro-Oxidation of D-Gluconic Acid and D-Arabinose," *Electrochimica Acta*, 39(10):1415-1417 (1994).
Pezzatini, G., et al., "Electro-oxidative Decarboxylation of D-Gluconic Acid to D-Arabinose on Graphite Electrodes," *Electroanalysis*, 4:129-132 (1992).
Supplementary European Search Report and Written Opinion for related European Application No. 14779807.8, dated Jul. 8, 2016 (9 pages).

* cited by examiner

*Primary Examiner* — Edna Wong
(74) *Attorney, Agent, or Firm* — Brinks Gilson & Lione; Ryan L. Marshall

(57) ABSTRACT

Methods for decarboxylating carbohydrate acids in a divided electrochemical cell are disclosed using a cation membrane. The improved methods are more cost-efficient and environmentally friendly than conventional methods.

14 Claims, No Drawings

METHODS FOR THE ELECTROLYTIC DECARBOXYLATION OF SUGARS

REFERENCE TO EARLIER FILED APPLICATION

This application is a 371 national phase of PCT/US2014/022689, filed Mar. 10, 2014, and claims the benefit under 35 U.S.C. §119(e) of U.S. Provisional Patent Application No. 61/777,890, filed Mar. 12, 2013, and titled 5 "METHODS FOR THE ELECTROLYTIC DECARBOXYLATION OF SUGARS," which is incorporated, in its entirety, by this reference.

TECHNICAL FIELD

The present disclosure relates to methods of electrolytically decarboxylating sugar acids and electrolytically generating alkali metal, or ammonium hydroxide solutions.

BACKGROUND

The electrolytic decarboxylation of sugar acids has been employed in the production of xylitol and erythritol, as in U.S. Pat. Nos. 7,598,374, 7,955,489, and U.S. Patent Publication US 2011/0180418. For example, U.S. Pat. No. 7,955,489, describes the electrolytic decarboxylation of aqueous D- or L-arabinonic acid at specific ranges of neutralization—the ratio of alkali metal cations to arabinonic acid—to yield erythrose. Therein, the neutralization of arabinonic acid is maintained in solution by converting alkali metal araboninic acid salts to a protonated form using cation exchange resin and electrodialysis. Moreover, they describe adding un-neutralized arabinonic acid to the reaction solution over the course of the reaction to replace the arabinonic acid consumed at the anode.

Electrolytic cells can be constructed in many different configurations. However, all previously disclosed examples of carbohydrate acid electrolytic decarboxylations are carried out in single-compartment cells to maintain particular levels of neutralization. Too little neutralization results in a significant reduction in conductivity and reaction efficiencies, and too much neutralization can lead to reaction inefficiencies and product instabilities. Moreover, the presence of inorganic anions is detrimental to electrode life, reaction efficiencies, and downstream product purification efficiencies. Consequently the addition of non-reagent acids to control the degree of reactant neutralization is undesirable.

As sugar acids are often produced as alkali metal salts, there remains a need for cost-effective methods to maintain sugar acid neutralization without further conversion of alkali metal salts of carbohydrate acids with cation exchange resin, electrodialysis, or by addition of un-neutralized carbohydrate acids.

SUMMARY

The present disclosure includes cost-effective methods for electrolytically decarboxylating carbohydrate acids concomitantly with the electrolytic production of alkali metal hydroxide solutions, or ammonium hydroxide solutions. The disclosure provides a method of decarboxylating a sugar acid by providing a solution comprising a carbohydrate acid; electrolytically decarboxylating the carbohydrate acid in the anode compartment of a two-compartment electrochemical cell; and generating an alkali metal hydroxide solution, or ammonium hydroxide solution, in the cathode compartment. The compartments are separated by a cation exchange membrane. As the reaction proceeds, for every one molecule of carbohydrate acid which is decarboxylated or molecule of oxygen evolved, approximately two alkali metal ions migrate across the cation exchange membrane and are removed from the anolyte to the catholyte thus maintaining charge balance.

In a first embodiment the alkali metal hydroxide concentration of the catholyte is maintained sufficiently high and the cation membrane is selected to induce back-migration of hydroxide ions across the cation membrane from the catholyte to the anolyte. In this embodiment, the current efficiency for alkali metal hydroxide production is less than 100%, is preferably less than 90% and more preferably less than 75%. In a particular embodiment the carbohydrate acid is arabinonic acid.

In a second embodiment, an alkali metal hydroxide is added to the anolyte to maintain the suitable neutralization. Preferably the alkali metal hydroxide produced in the cathode chamber is added to the anolyte of a carbohydrate decarboxylation in order to maintain a preferred level of carbohydrate acid neutralization. In a particular embodiment the carbohydrate acid is arabinonic acid.

In a third embodiment, the decarboxylation of a carbohydrate acid occurs at an anode surface to yield an aldose, in which the ratio of sodium to carbohydrate acid is maintained by concurrently circulating the reactant solution through two sets of electrolytic cells, where one set of cells is a divided cell with a cationic membrane and the other is an undivided cell. In a particular embodiment the carbohydrate acid is arabinonic acid.

In a fourth embodiment, the carbohydrate acid reactant is obtained from a suitable carbohydrate starting material by alkali oxidation. Preferably, the alkali metal hydroxide produced in the cathode chamber is used in the alkali oxidation of subsequent carbohydrate acid reactant. For example, D-arabinonic acid may be prepared by oxidizing D-glucose with oxygen gas in an alkaline water solution; L-arabinonic acid may be prepared by oxidizing L-arabinose with oxygen gas and a platinum group metal catalyst in an alkaline water solution; methyl alpha-D-glucuronoside may be prepared by oxidizing methyl alpha-D-glucoside with oxygen gas and a platinum group metal catalyst in an alkaline water solution; D-gluconate may be prepared by oxidizing D-glucose with oxygen gas and a platinum group metal catalyst in an alkaline water solution.

DETAILED DESCRIPTION

Definitions

As used herein, the term "carbohydrate acid" refers to any aldonic acid, uronic acid or aldaric acid.

"Aldonic acid" refers to any polyhydroxy acid compound comprising the general formula $HOCH_2[CH(OH)]_nC(=O)OH$ (where n is any integer, including 1-20, but preferably 1-12, more preferably 4-7), as well as derivatives, analogs and salts thereof Aldonic acids can be derived, for example, from an aldose by oxidation of the aldehyde function (e.g., D-gluconic acid).

"Uronic acid" refers to any polyhydroxy acid compound comprising the general formula $O{=}CH[CH(OH)]_nC(=O)OH$ (where n is any integer, including 1-20, but preferably 1-12, more preferably 4-7), as well as derivatives, analogs and salts thereof Uronic acids can be derived, for example, from an aldose by oxidation of the primary alcohol function (e.g., D-glucuronic acid).

"Aldaric acid" refers to any polyhydroxy acid compound comprising the general formula HO(O=)C[CH(OH)]$_n$C(=O)OH (where n is any integer, including 1-20, but preferably 1-12, more preferably 4-7), as well as derivatives, analogs and salts thereof Aldaric acids can be derived, for example, from an aldose by oxidation of both the aldehyde function and the primary alcohol function (e.g., D-glucaric acid).

"Arabinonic acid" as used herein refers to an aldonic acid carbohydrate with chemical formula $C_5H_{10}O_6$, including any stereoisomers, derivatives, analogs and salts thereof Unless otherwise indicated, recitation of "arabinonic acid" herein is intended to include, without limitation, the molecules: D-(−)-arabinonic acid, L(+)-arabinonic acid, D(−)-arabinonic acid, D-arabinonic acid, L-arabinonic acid, and D(−)-arabinonic acid and meso-arabinonic acid. Arabinonic acid is also referred to as arabonic acid and arabinoic acid.

"Gluconic acid" refers to an aldonic acid carbohydrate with chemical formula $C_6H_{12}O_7$, including derivatives, analogs and salts thereof Unless otherwise indicated, recitation of "gluconic acid" herein is intended to refer to D-gluconic acid, D-(−)-gluconic acid, D(−)-gluconic acid.

"D-glucuronic acid" refers to an uronic acid carbohydrate with the chemical formula $C_6H_{10}O_7$ including derivatives, analogs, and salts thereof Unless otherwise indicated, recitation of "d-glucuronic acid" herein is intended to include, without limitation, the molecules d-(−)-glucuronic acid, d-glucuronic acid, (alpha)-d-glucuronic acid, (beta)-d-glucuronic acid, and (alpha,beta)-d-glucuronic acid.

"Methyl-d-glucuronoside" refers to an uronic acid carbohydrate with the chemical formula $C_7H_{12}O_7$, including derivatives, analogs and salts thereof Unless otherwise indicated, recitation of "methyl-d-glucuronoside" herein is intended to include, without limitation, the molecules 1-O-methyl-(alpha)-d-glucopyranosiduronic acid, 1-O-methyl-(beta)-d-glucopyranosiduronic acid and 1-O-methyl-(alpha, beta)-d-glucopyranosiduronic acid.

"D-galacturonic acid" refers to an uronic acid carbohydrate with the chemical formula $C_6H_{10}O_7$ including derivatives, analogs, and salts thereof Unless otherwise indicated, recitation of "d-galacturonic acid" herein is intended to include, without limitation, the molecules d-(−)-d-galacturonic acid, d-galacturonic acid, (alpha)-d-galacturonic acid, (beta)-d-galacturonic acid, and (alpha,beta)-d-galacturonic acid.

"Erythrose" refers to an aldose (tetrose) carbohydrate with chemical formula $C_4H_8O_4$, including any stereoisomers, derivatives, analogs and salts thereof Unless otherwise indicated, recitation of "erythrose" herein is intended to include, without limitation, the molecules: D-(−)-erythrose, L(+)-erythrose, D(−)-erythrose, D-erythrose, L-erythrose and D(−)-erythrose and meso-erythrose. A Fischer Projection of the D-erythrose structure (1) is provided below.

(1)

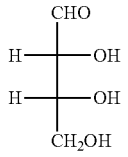

"Decarboxylation" as used herein refers to the removal of a carboxyl group (—COOH) by a chemical reaction or physical process. Typical products of a decarboxylation reaction may include carbon dioxide ($CO_2$) or formic acid.

The term "electrochemical" refers to chemical reactions that can take place at the interface of an electrical conductor (an electrode) and an ionic conductor (the electrolyte). Electrochemical reactions can create a potential between two conducting materials (or two portions of a single conducting material), or can be caused by application of external voltage. In general, electrochemistry deals with situations where an oxidation reaction and a reduction reaction are separated in space.

The term "electrolytic" as used herein refers to an electrochemical oxidation or reduction reaction that results in the breaking of one or more chemical bonds. Electrolytic reactions as used herein describe reactions occurring as a product of interaction with a cathode or anode.

As used herein, "derivative" refers to a chemically or biologically modified version of a chemical compound that is structurally similar to a parent compound and (actually or theoretically) derivable from that parent compound. A derivative mayor may not have different chemical or physical properties of the parent compound. For example, the derivative may be more hydrophilic or it may have altered reactivity as compared to the parent compound. Derivatization (i.e., modification) may involve substitution of one or more moieties within the molecule (e.g., a change in functional group) that do not substantially alter the function of the molecule for a desired purpose. The term "derivative" is also used to describe all solvates, for example hydrates or adducts (e.g., adducts with alcohols), active metabolites, and salts of the parent compound. The type of salt that may be prepared depends on the nature of the moieties within the compound. For example, acidic groups, for example carboxylic acid groups, can form, for example, alkali metal salts or alkaline earth metal salts (e.g., sodium salts, potassium salts, magnesium salts and calcium salts, and also salts quaternary ammonium ions and acid addition salts with ammonia and physiologically tolerable organic amines such as, for example, triethylamine, ethanolamine or tris-(2-hydroxyethyl)amine) Basic groups can form acid addition salts, for example with inorganic acids such as hydrochloric acid, sulfuric acid or phosphoric acid, or with organic carboxylic acids and sulfonic acids such as acetic acid, citric acid, benzoic acid, maleic acid, fumaric acid, tartaric acid, methanesulfonic acid or p-toluenesulfonic acid. Compounds which simultaneously contain a basic group and an acidic group, for example a carboxyl group in addition to basic nitrogen atoms, can be present as zwitterions. Salts can be obtained by customary methods known to those skilled in the art, for example by combining a compound with an inorganic or organic acid or base in a solvent or diluent, or from other salts by cation exchange or anion exchange.

As used herein, "analogue" refers to a chemical compound that is structurally similar to another but differs slightly in composition (as in the replacement of one atom by an atom of a different element or in the presence of a particular functional group), but may or may not be derivable from the parent compound. A "derivative" differs from an "analogue" in that a parent compound may be the starting material to generate a "derivative," whereas the parent compound may not necessarily be used as the starting material to generate an "analogue."

Any concentration ranges, percentage range, or ratio range recited herein are to be understood to include concentrations, percentages or ratios of any integer within that range and fractions thereof, such as one tenth and one hundredth of an integer, unless otherwise indicated. Also, any number range recited herein relating to any physical feature, such as polymer subunits, size or thickness, are to be understood to include any integer within the recited range, unless otherwise indicated. It should be understood that the terms "a" and "an" as used above and elsewhere herein refer to "one or more" of the enumerated components. For example, "a" polymer refers to one polymer or a mixture comprising two or more polymers. As used herein, the term "about" refers to differences that are insubstantial for the relevant purpose or function.

Electrochemical Decarboxylation

The process of eletrolytically decarboxylating a carbohydrate acid in an electrochemical cell is describe below. The step of electrochemical oxidative decarboxylation of a reactant substrate can be performed on the reactant substrate. In some embodiments, the methods include the step of electrolytic decarboxylating the carbohydrate acid reactant to produce a carbohydrate.

The reactant can be provided as a solution placed in contact with an electrode. The solution includes the reactant and a solvent. The reactant can be dissolved in the solvent by any suitable method, including stirring and/or heating where appropriate. The solvent can be any solvent in which the reactant can dissolve to a desired extent. Preferably, the solvent is aqueous.

In one embodiment, any suitable carbohydrate acid capable of producing a carbohydrate as a product of an electrolytic decarboxylation step can be used as a reactant. In one embodiment, the reactant is arabinonic acid as well as suitable derivatives, analogs and salts of the reactants. Suitable reactants include derivatives and analogs of the carbohydrate acid reactant can include reactants with chemical structure variations that insubstantially vary the reactivity of the molecule from undergoing an electrolytic decarboxylation process to produce either erythrose or an intermediate that can be converted to erythrose.

The decarboxylation reaction is performed electrochemically. In one aspect, electrolytic decarboxylation of a reactant in a solution provides a desired product or intermediate that can be subsequently converted to the desired product. In some embodiments, the reactant is arabinonic acid, such as D- or L-arabinonic acid, and the product is an erythrose, such as D- or L-erythrose.

In some embodiments, at least about 10% of the acid is neutralized—that is it exists as a corresponding salt thereof. For example, the acid reactant solution can be provided with about 10, 20, 30, 40, 50, 60, 70, 80, 90, or 100% of one or more reactant acids equivalents neutralized. In some embodiments, 10%-100% of at least one ribonic acid or arabinonic acid reactant is neutralized.

In one aspect, the pH or percent neutralization could be provided and/or maintained within a desirable range throughout the reaction, for example by using a divided electrolytic cell with a cation exchange membrane and adding an alkali metal hydroxide to the anolyte. In another aspect, the pH or percent neutralization could be provided and/or maintained within a desirable range throughout the reaction, for example by simultaneously passing the anolyte through two sets of electrolytic cells, one a divided electrolytic cell with a cation exchange membrane, and the other a single compartment cell. The reactant carbohydrate acid solution can have any suitable pH to provide a desired concentration of dissociated reactant. For a reactant solution comprising an arabinonic acid reactant, the pH can be between 3.0 and 6.0 during the decarboxylation reaction.

Optionally, the residual reactant can be recycled by separating the starting material from products, for example by use of a cation exchange chromatographic resin. A partially decarboxylated solution of carbohydrate acid can contain both the starting carbohydrate acid (e.g., arabinonic acid) and the product (e.g., erythrose). A partially reacted solution can be passed over a bed or column of ion exchange resin beads for a chromatographic separation of the reactant and the product.

Electrolytic Apparatus

The electrochemical decarboxylation of a carbohydrate acid reactant can be performed using a two compartment electrolytic cell divided by a cation exchange membrane. The electrochemical decarboxylation is performed by contacting a solution containing carbohydrate acid with an anode, where the reactant can be decarboxylated. Contact between the reactant material and the anode can elicit the decarboxylation, resulting in carbon dioxide and a product carbohydrate.

The cell includes an anode. The anode can be formed from any suitable material such as graphite, pyrolytic carbon, impregnated or filled graphite, glassy carbon, carbon cloth, or platinum. In some embodiments, the anode preferably comprises a carbon reactive surface where oxidation of the reactant acid can occur. In one embodiment, the anode surface comprises a highly crystalline graphitic material, such as a graphite foil flexible graphite. Other materials such as platinum or gold can also be used to form the anode's reactive surface. In one embodiment, the reactant carbohydrate acid is arabinonic acid and is oxidized at or near the anode's reactant surface forming erythrose.

The cell also includes a cathode where a reduction can occur within the electrochemical cell. The cathode can be formed from any suitable material having a desired level of electrical conductivity, such as stainless steel or nickel. In one embodiment, the decarboxylation reaction at the anode can be:

$$\text{Arabinonic acid} - 2e^- \text{- - - - - - ->erythrose} + CO_2 + 2H^+$$

The counter electrode reaction can be:

$$2H_2O + 2e^- \text{- - - - - >} 2OH^- + H_2$$

Typically, some current can be lost to the production of $O_2$ gas at the anode.

The cell also includes a cation selective membrane dividing the anolyte and catholyte solutions and compartments. The membrane could include, for example, heterogeneous or homogenous membranes. The latter could be a polymeric membrane with sulfonate or carboxylate ion exchange groups. The polymer could be hydrocarbon based or fluorocarbon based. As an example, Nafion(R) 115 (DuPont™ Fuel Cell) membrane is a perfluorosulfonic acid membrane that selectively transports cations.

In one aspect, water is reduced at or near the surface of the cathode to hydroxide ion and hydrogen gas. As the reaction proceeds, alkali metal cations pass from the anolyte to the catholyte across a cation exchange membrane and act as the counter-ion to the hydroxide, generating a alkali metal hydroxide solution.

The electrochemical cell can be configured electrically in either a monopolar or bipolar configuration. In the monopolar configuration, an electrical contact is made to each electrode. In the bipolar configuration each electrode has a cathode and an anode side and electrical connection is made only to the electrodes positioned at the ends of the cell stack comprising multiple electrodes.

Alkali Oxidation of a Carbohydrate

In another aspect, the carbohydrate acid can be obtained from a suitable carbohydrate starting material by alkali oxidation. In one embodiment, the carbohydrate acid is arabinonic acid, which is prepared by oxidizing a starting material comprising glucose or fructose with oxygen gas in an alkaline water solution (for example, as described in U.S. Pat. Nos. 4,125,559 and 5,831,078, incorporated herein by reference). The starting material may include glucose, fructose, or a mixture thereof, and the starting material is reacted with an alkali metal hydroxide and oxygen gas in aqueous solution by first heating the alkali metal hydroxide in aqueous solution at a temperature between about 30° C. and 100° C. The starting material can be a D-hexose such as D-glucose, D-fructose or D-mannose, which can be present in various ring forms (pyranoses and furanoses) and as various diastereomers, such as (alpha)-D-glucopyranose and (beta)-D-glucopyranose. The starting material can be reacted with the alkali metal hydroxide in a stoichiometric amount, or in excess, using for example an amount of from 2 to 5 equivalents of the alkali metal per mole of the D-hexose. For example, alkali metal hydroxides may be sodium hydroxide or potassium hydroxide. The oxygen is preferably used in a stoichoimetric amount or in excess, but preferably with an amount of from 1 to 20 moles of $O_2$ per mole of the D-hexose starting material. The reaction can be carried out at above 30° C., and under a pressure of about 1 to 50 bars. The reaction may be performed continuously or batchwise, in a suitable solvent.

Alternatively, fructose (such as D-fructose) can be converted to D-arabinonic acid by reaction with oxygen gas in an alkaline water solution as described in J. Dubourg and P. Naffa, "Oxydation des hexoses reducteur par l'oxygene en milieu alcalin," *Memoires Presentes a la Societe Chimique*, p. 1353, incorporated herein by reference. The carbohydrate acid can also be obtained from the noble metal catalyzed alkali oxidation of aldoses and aldosides. In a particular embodiment, the carbohydrate acid is arabinonic acid, which can be prepared by oxidizing a starting material such as D- or L-arabinose with oxygen gas and a noble metal catalyst in an alkaline water solution, see Bright T. Kusema, Betiana C. Campo, Päivi Mäki-Arvela, Tapio Salmi, Dmitry Yu. Murzin , "Selective catalytic oxidation of arabinose—A comparison of gold and palladium catalysts," *Applied Catalysis A: General* 386 (2010): 101-108, incorporated herein by reference.

Gluconic acid can be prepared by oxidizing glucose with oxygen gas and a noble metal catalyst in an alkali water solution, for example, as described in Ivana Dencicl, Jan Meuldijkl, Mart Croonl, Volker Hessel "From a Review of Noble Metal versus Enzyme Catalysts for Glucose Oxidation Under Conventional Conditions Towards a Process Design Analysis for Continuous-flow Operation," *Journal of Flow Chemistry* 1 (August 2011): 13-23, incorporated herein by reference. Methyl-d-glucuronopyranoside can be prepared by oxidizing glucose with oxygen gas and a noble metal catalyst in an alkali water solution, for example, as described in A. P. Markusse, B. F. M. Kuster, J. C. Schouten, "Platinum catalysed aqueous methyl-d-glucopyranoside oxidation in a multiphase redox-cycle reactor," *Catalysis Today* 66 (2001) 191-197, incorporated herein by reference.

The alkali metal hydroxide used for the preparation of the carbohydrate acid reactant can be produced in the cathode compartment of an electrolytic cell described herein during a prior or simultaneous decarboxylation of a carbohydrate acid.

EXAMPLES

The following examples are to be considered illustrative of various aspects of the invention and should not be construed to limit the scope of the invention, which are defined by the appended claims.

Example 1

A plate and frame type electrochemical cell was prepared using a 0.12 $m^2$ anode, 0.12 $m^2$ cathode, a membrane dividing the chambers, and turbulence promoting plastic meshes between the electrodes and membrane on each side. The anode was graphite foil and the cathode was a sheet of Nickel 200. The membrane was cation exchange membrane FumaTech FKB. The anode and cathode were sealed into polyethylene flow frames which distribute solution flow across the electrode surfaces. Anolyte flow through the electrochemical cell was controlled at a linear flow rate of 7 cm per second across the anode and the catholyte flow rate was set to match. Power to the cell was provided by an external power supply at a current density of 150 $mA/cm^2$. The initial anolyte consisted of a 2.5 Molar arabonic acid solution, which was 100% neutralized and in the sodium salt form. To maintain the desired neutralization of the arabonic acid (pH of 5.15 in the anolyte tank), sodium hydroxide was delivered to the anolyte tank. The catholyte was a 1.89M sodium hydroxide solution the concentration of which was maintained (+/−0.2 Molar) throughout the electrolysis by the addition of deionized water.

The electrolysis was run until 402 Amp-hours of charge had passed; the current efficiency for erythrose and sodium hydroxide formation was measured as 91% and 87% respectively.

Example 2

The following example used the same cell and electrolysis setup as Example 1; the parameter changed was the catholyte sodium hydroxide concentration. The catholyte concentration was maintained between 4.4 and 4.7M Sodium hydroxide by the addition of deionized water. The electrolysis was continued until 402 amp-hours of charge had passed. The current efficiency for erythrose formation was measured at 87%. The current efficiency for sodium hydroxide production in the catholyte was 64%. This back-migration of hydroxide again reduced the amount of caustic addition required to maintain the anolyte neutralization to 3.3 moles (compared to 6.7 moles when a 2M sodium hydroxide catholyte was used).

Example 3

The following example used the same cell and electrolysis setup as Example 1. In this experiment, the catholyte concentration was maintained at 5M sodium hydroxide by the addition of deionized water. The neutralization of the arabonic acid was maintained by the addition of 5.3M sodium hydroxide, which was produced as the catholyte during the decarboxylation of arabonic acid using the setup described in Example 1. The current efficiency for erythrose formation was 92%.

Example 4

The method of example 1 was repeated with anolytes consisting of 2.5 M D-gluconic acid, 2.5 Molar D-glucuronic acid, and 2.5 Molar D-galacturonic acid. The method decarboxylated D-gluconic acid to yield D-arabinose with a current efficiency of 100%. The method decarboxylated D-glucuronic acid to yield xylo-pent-1,5-diose with a current efficiency of 49%. The method decarboxylated D-galacturonic acid to yield L-arabino-1,5-diose with a current efficiency of 20%.

Example 5

The method of example 2 was used to produce 5.4 M sodium hydroxide. 100 grams of a 20% wt/wt solution of D-glucose was placed in a high pressure reaction vessel equipped with a gas shaft turbine. The vessel was purged with oxygen and then brought to 50 bar pressure of oxygen, with the temperature maintained at 45° C. 0.244 moles of sodium hydroxide from example 2 was added over 72 minutes, after which the reaction was allowed to proceed for another 25 minutes. The reaction yielded 17 grams of sodium arabonate.

We claim:

1. A method of decarboxylating a carbohydrate acid in an electrochemical cell, comprising:

providing an electrochemical cell having two compartments divided by a cation exchange membrane for monovalent cation transfer between the two compartments, the first compartment containing catholyte and a cathode, and the second compartment containing a carbohydrate acid, anolyte, and an anode, wherein the carbohydrate acid is at least 10% neutralized as a salt of the monovalent cation;

providing an electrical current to the cell thereby producing an aldehydic carbohydrate in the anolyte and a hydroxide ion in the catholyte;

inducing migration of the hydroxide ion across the cation exchange membrane from the catholyte to the anolyte, wherein the cation exchange membrane is permeable to the hydroxide ion to at least partially maintain a ratio of the monovalent cation to the carbohydrate acid; and adding a cation hydroxide to the anolyte selected from the group consisting of sodium hydroxide, potassium hydroxide, lithium hydroxide, and ammonium hydroxide;

wherein the current efficiency for the monovalent cation transfer across the cation exchange membrane is less than 90%;

wherein the ratio of the monovalent cation to the carbohydrate acid maintains neutralization of the available carbohydrate acid for decarboxylation;

wherein the catholyte comprises water.

2. The method of claim 1, wherein the hydroxide ion and the monovalent cation form a monovalent cation hydroxide in the catholyte and the monovalent cation hydroxide is added to the anolyte of the divided cell during the decarboxylation of the carbohydrate acid.

3. The method of claim 2, wherein the carbohydrate acid is selected from the group consisting of: arabinoic acid, d-gluconic acid, methyl-d-glucuronoside acid, d-glucuronic acid, and d-galacturonic acid.

4. The method of claim 3, wherein the carbohydrate acid is arabinonic acid.

5. The method of claim 2, wherein the carbohydrate acid is produced using the hydroxide ion produced in the catholyte.

6. The method of claim 1, wherein the ratio of the monovalent cation to the carbohydrate acid is at least partially maintained by concurrently circulating a carbohydrate acid solution through two sets of electrolytic cells, where one set of cells is the electrochemical cell having two compartments divided by the cation exchange membrane and the other is an undivided cell.

7. The method of claim 6, wherein the carbohydrate acid is selected from the group consisting of: arabinoic acid, d-gluconic acid, methyl-d-glucuronoside acid, d-glucuronic acid, and d-galacturonic acid.

8. The method of claim 7, wherein the carbohydrate acid is arabinonic acid.

9. The method of claim 6, wherein the carbohydrate acid is produced using the hydroxide ion produced in the catholyte.

10. The method of claim 1, wherein the carbohydrate acid is selected from the group consisting of: arabinoic acid, d-gluconic acid, methyl-d-glucuronoside acid, d-glucuronic acid, and d-galacturonic acid.

11. The method of claim 10, wherein the carbohydrate acid is arabinonic acid.

12. The method of claim 11, wherein the carbohydrate acid is produced using the hydroxide ion produced in the catholyte.

13. The method of claim 10, wherein the carbohydrate acid is produced using the hydroxide ion produced in the catholyte.

14. The method of claim 1, wherein the carbohydrate acid is produced using the hydroxide ion produced in the catholyte.

* * * * *